US006805169B2

(12) United States Patent
Schuppert, Jr. et al.

(10) Patent No.: US 6,805,169 B2
(45) Date of Patent: Oct. 19, 2004

(54) METHOD AND APPARATUS FOR WIRE SPLICING

(75) Inventors: Leo V. Schuppert, Jr., York, PA (US); David J. Erb, Harrisburg, PA (US)

(73) Assignee: Tyco Electronic Corporation, Middletown, PA (US)

( * ) Notice: Subject to any disclaimer, the term of this patent is extended or adjusted under 35 U.S.C. 154(b) by 0 days.

(21) Appl. No.: 10/260,474

(22) Filed: Sep. 30, 2002

(65) Prior Publication Data

US 2004/0060338 A1 Apr. 1, 2004

(51) Int. Cl.[7] ..... H01R 43/045

(52) U.S. Cl. ..... 140/106; 29/751; 29/816; 72/409.06

(58) Field of Search ..... 29/566.2, 566.4, 29/751, 758, 816; 72/409.06, 409.14; 140/106, 117, 121, 123

(56) References Cited

U.S. PATENT DOCUMENTS

| | | | | | |
|---|---|---|---|---|---|
| 3,249,992 | A | * | 5/1966 | Long | 29/566.2 |
| 3,393,438 | A | * | 7/1968 | James et al. | 29/566.4 |
| 3,641,656 | A | * | 2/1972 | Langas et al. | 29/243.57 |
| 3,707,867 | A | * | 1/1973 | Mayala | 72/409.06 |
| 4,953,384 | A | | 9/1990 | Baillet et al. | 72/410 |
| 5,307,553 | A | * | 5/1994 | Frohlich | 29/556.2 |
| 5,347,705 | A | | 9/1994 | Schmode et al. | 29/566.4 |
| 6,317,970 | B1 | * | 11/2001 | Leistner et al. | 29/816 |

FOREIGN PATENT DOCUMENTS

| | | |
|---|---|---|
| DE | 41 04 736 A1 | 8/1992 |
| EP | 0 318 065 A1 | 5/1989 |

* cited by examiner

*Primary Examiner*—Daniel C. Crane

(57) ABSTRACT

The present invention relates to a wire termination system for terminating wires in at least one of a plurality of terminal connectors removably affixed to each other in a terminal connector strip that includes a body having a connector positioning cavity therein for receiving the terminal connector strip; a pushing element within the positioning cavity for advancing the terminal connector strip within the positioning cavity; a crimping element for receiving at least one of the plurality of terminal connectors from the pushing element; a support within the positioning cavity for positioning at least one of the plurality of terminal connectors within the crimping element; and a handle moveably attached to the crimping element and the body, wherein the handle and the crimping element are configured to terminate the wires within at least one of the plurality of terminal connectors and to separate the terminal connector from the terminal connector strip.

14 Claims, 5 Drawing Sheets

METHOD AND APPARATUS FOR WIRE SPLICING

FIELD OF THE INVENTION

The present invention is related to wiring splicing systems. More particularly, the present invention is related to a terminal connector strip and associated crimping tool for terminating wires.

BACKGROUND

Communication cables, such as telephone and computer network cables, and the like, are typically interconnected by terminating the individual wires within each cable with a terminating connector for insertion into patch panel, jack or the like. The connector is terminated by inserting the wires to be spliced into the terminal connector and then applying pressure to the terminal, causing a portion of it to crimp against the wires, holding them in place and creating an electrical contact between the terminal wire and the metal contacts within the terminal connector. This is typically accomplished by using a crimping tool.

Terminating systems have conventionally utilized individual terminal connectors, or connectors that are fastened together with adhesive tape, that are inserted into the terminating tool and are crimped into place. In addition, terminating systems have incorporated a cartridge tube containing multiple rows of loose terminal connectors that are fed into the crimping tool as each set of wires is terminated. A hand-actuated crimping tool feeds connectors into the crimping area from the aforementioned prepackaged expendable cartridges. In some models, in operation, a pusher mechanism is drawn back against a counter spring so that the taped connectors or connector cartridge may be loaded into the tool body. In other systems of the prior art, a rear cover on the tool is opened and a retractable draw cord used to pull back a spring-mounted pusher assembly until it is locked in the rear position by a pusher latch. An end cap is removed from the front end of the cartridge, which is then inserted into the tool. The rear cover is closed and latched, releasing the pusher and positioning the first connector into the terminating area.

The wires to be terminated are then placed onto wire guides, which ensure that the wires have been split by separators and are lying in the proper wire channels. The wires are then fully inserted into the connectors, and the handle is closed and then allowed to open. Pulling the handle closed forces a terminating pin to terminate a wire within the connector in the manner previously described. When the handle is released, the tool automatically ejects the terminated connector and positions a new connector for termination.

However, these systems have significant disadvantages. For example, the use of individual connectors is a slow and tedious process, since the user must individually load the tube or cartridge with connectors for use within the crimping tool. These systems also require expensive packaging to accommodate a single-track tube or four track cartridges. Moreover, the four track cartridges are typically difficult to load. The pusher latching mechanism described above is often unreliable, and the drawstring extends out of the rear of the tool. The tool body is square and not ergonomic; it is uncomfortable for the user. And, the selector knob on the front of tool often gets in the way when terminating wires in an enclosure.

Accordingly, a system is needed that improves upon these disadvantages in the prior art.

SUMMARY OF THE INVENTION

The present invention is directed to a wire termination system for terminating wires in at least one of a plurality of terminal connectors removably affixed to each other in a terminal connector strip that includes a body having a connector positioning cavity therein for receiving the terminal connector strip; a pushing element within the positioning cavity for advancing the terminal connector strip within the positioning cavity; a crimping element for receiving at least one of the plurality of terminal connectors from the pushing element; a support within the positioning cavity for positioning at least one of the plurality of connectors within the crimping element; and a handle moveably attached to the crimping element and the body, wherein the handle and the crimping element are configured to terminate the wires within at least one of the plurality of terminal connectors and to separate the terminal connector from the terminal connector strip.

The wire terminator body also preferably includes a track along which the pushing element travels, wherein the track has a latch positioned to restrain the pushing element to allow the terminal connector strip to be inserted into the cavity. The tool body also preferably includes a slot window for viewing the terminal connector strip, a guide rail within the connector positioning cavity for guiding the terminal connector prior to termination and preventing the cover of the trailing connector from closing during termination, a key in the track to prevent the terminal connector strip from being loaded incorrectly, and one or more gauges for verifying the terminal connection.

DETAILED DESCRIPTION

The invention will be understood more fully from the detailed description given below and from the accompanying drawings of the preferred embodiments of the invention; which, however, should not be taken to limit the invention to a specific embodiment but are for explanation and understanding only.

Figure 1:
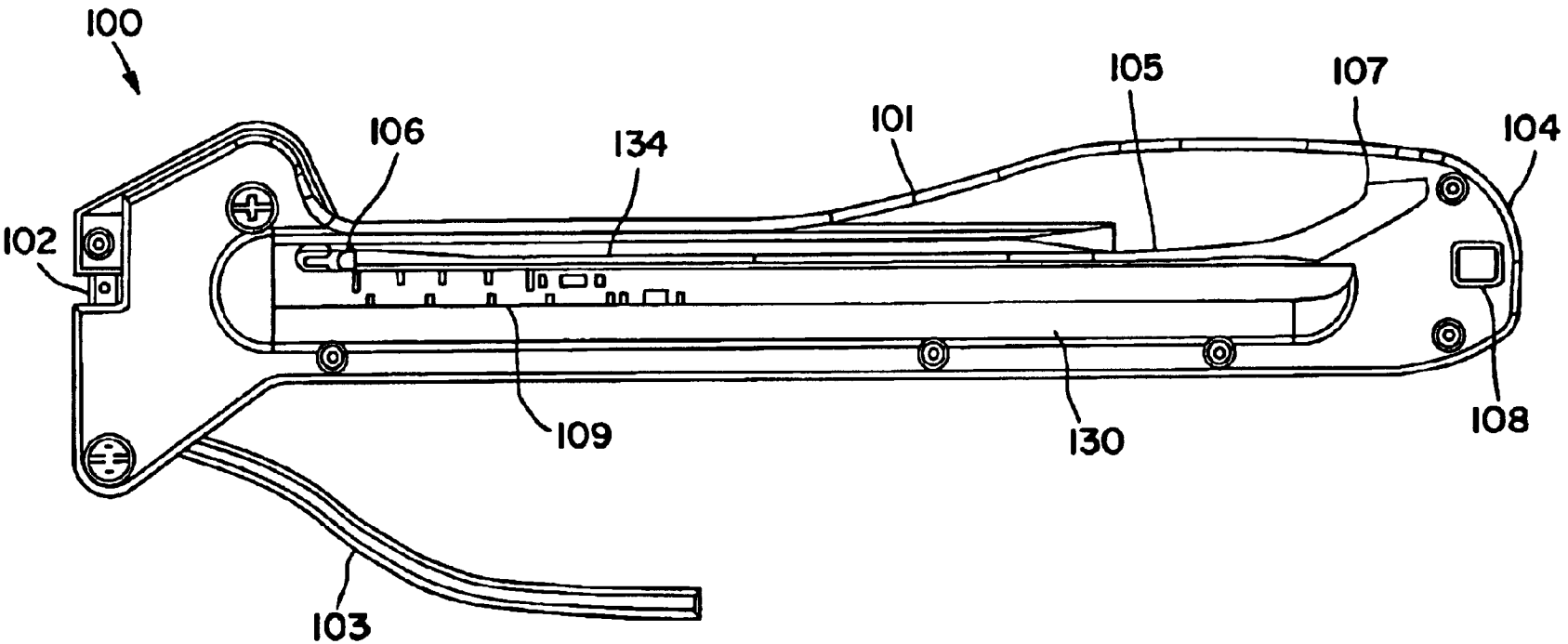
FIG. 1 is a drawing illustrating a preferred embodiment of a terminal connector tool in accordance with the invention.

The figures illustrate a preferred embodiment of a terminating tool in accordance with aspects of the invention. As shown in FIG. 1, terminating tool (100) includes a tool body (101) having crimping element (102), which is moveably attached to handle (103) to effectuate termination of wires, such as telephone cable wires, computer cable wires, and the like, to terminal connectors. Terminating tool (100) further includes end (104), into which a terminal connector strip is inserted, as described in more detail below. The terminating tool body (101) also includes a pusher track (105) for guiding pusher assembly (106). Pusher latch (107) is positioned at one end of pusher track (105) for securing pusher assembly (106) during the insertion of the terminal connector strip. The terminating tool also may include opening (108) in proximity to end (104), for attaching terminating tool (100) to a tool belt or the like.

Figure 2A:
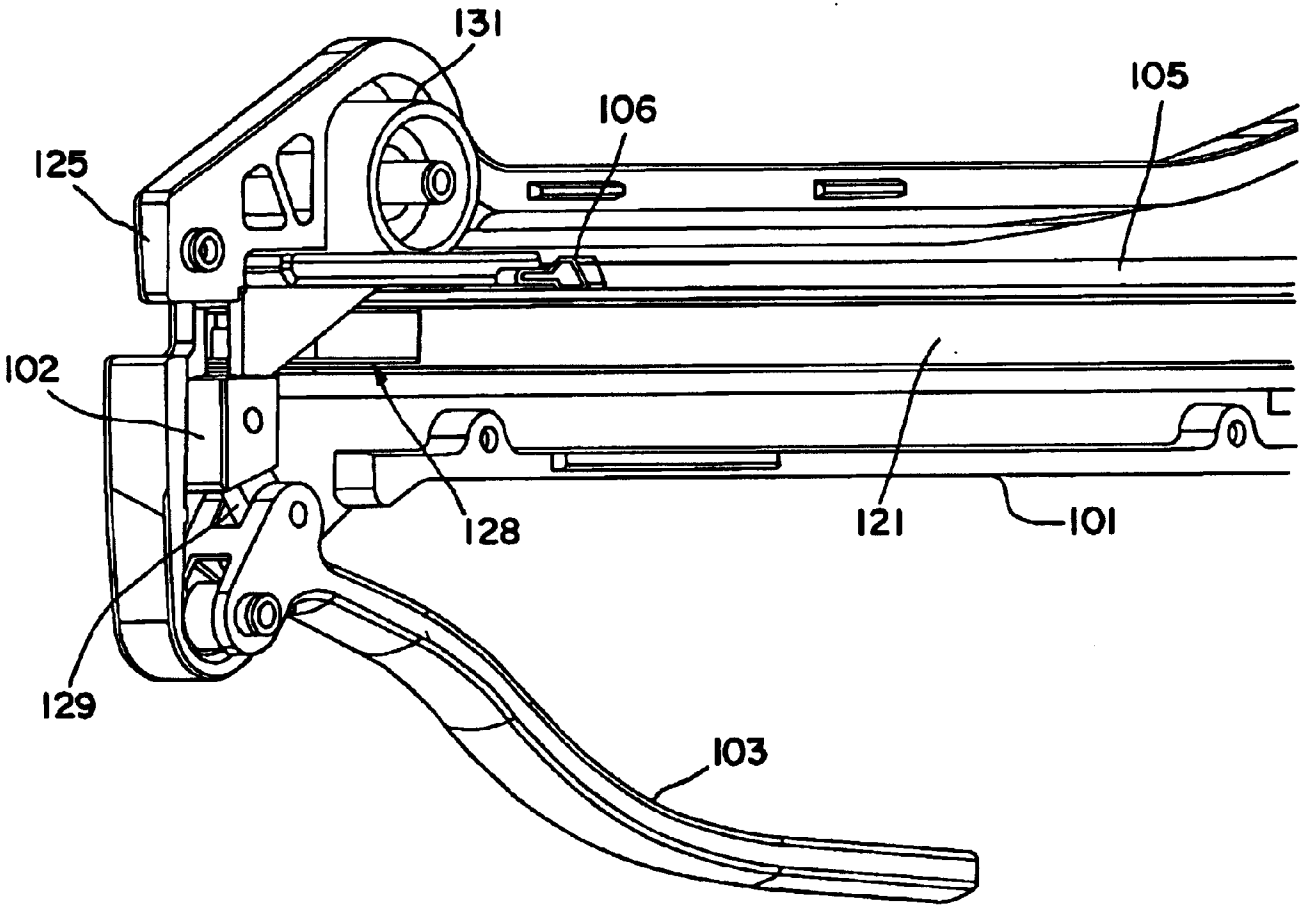
FIGS. 2(*a*)–(*c*) are cutaway drawings of the preferred embodiment of a terminal connector tool in accordance with the invention.
Figure 2B:
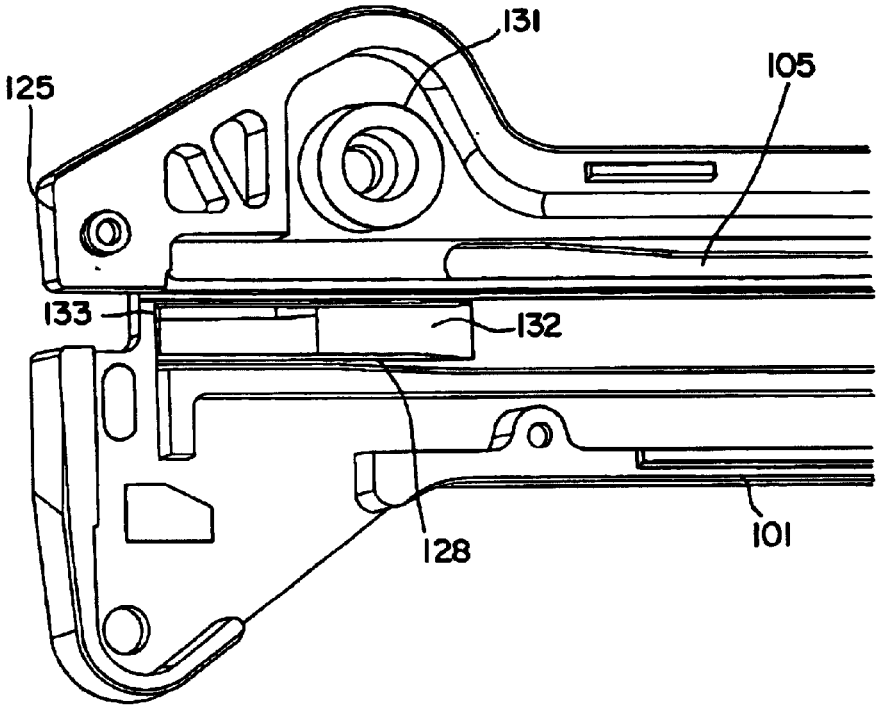
Figure 2C:
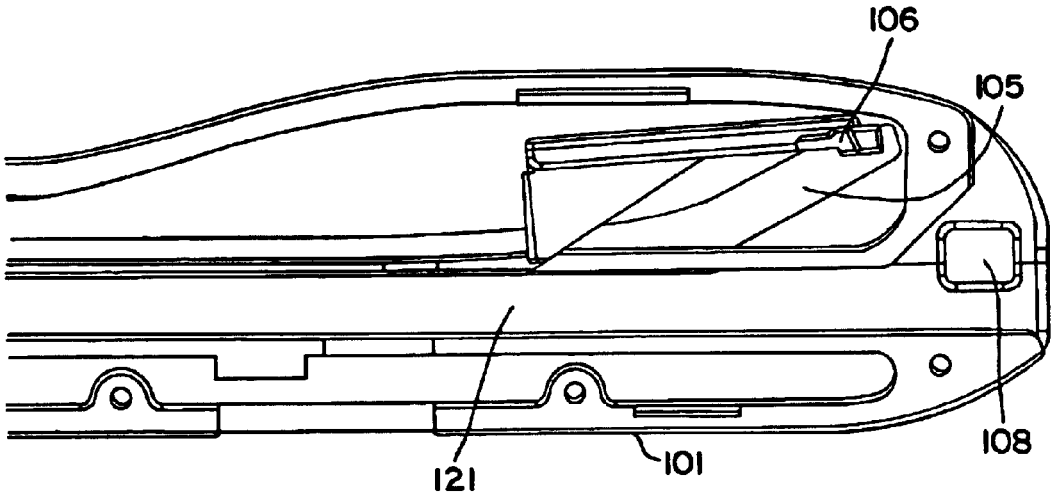

As shown in FIGS. 2(*a*)–(*c*), crimping element (102) may comprise, for example, a metal block, such as steel or any suitable material for providing pressure on the terminal connector. Crimping element (102) is attached to handle (103) using cam arm (129) in the manner shown. In this configuration, when handle (103) is moved toward tool body (101), cam arm (129) is thrust upward, forcing crimping element (102) against the terminal connector, which is in turn forced against flange (125) to complete the termination. Handle (103) also typically includes a counter spring (not shown) to provide a force for returning handle (103) to its extended position.

Pusher assembly (106) pushes the terminal connectors forward along keyed track (121) using a number of means. For example, pusher assembly may be attached to coil spring mechanism (131), which is mounted within the front portion of tool body (101), as shown, to provide a tensioning force to draw the assembly forward.

As shown in FIG. 1, the terminating tool (100) also preferably includes scales (109) for both two-wire and three-wire connectors. These scales help the user to identify the last few connectors remaining in the terminator connector strip within terminating tool (100). When using this scale, the user should relate the trailing edge of pusher assembly (106) with the proper scale to correctly determine how many connectors are remaining. For example, the user may reference a two-wire scale when using two-wire connectors, and a three-wire scale when using three-wire connectors. Other embodiments may provide termination for other wire connectors, e.g. single wire, four wire, etc.

Figure 3:
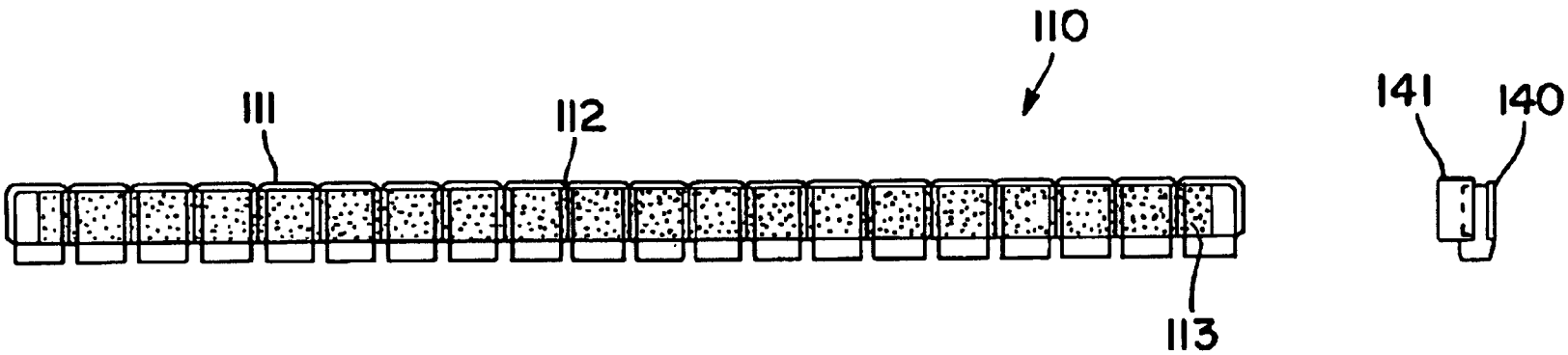
FIG. 3 is a drawing illustrating a preferred embodiment of a terminal connector strip in accordance with the invention.

A preferred embodiment of a terminator connector strip is shown in FIG. 3. As shown in FIG. 3, terminator connector strip (110) preferably comprises a series of individual terminal connectors (111) that are connected together to form a single strip or stick. Different means may be used to fasten the terminal connectors (111) together, such as the use of adhesive tape (113), which is affixed to the outside edge of the terminal connectors, as shown. However the connectors are preferably ultrasonically welded to each other at edges (112). Each terminator connector (111) typically comprises a base portion (140) and a cover portion (141). When the wires to be terminated are loaded into connector (111), cover portion (141) is pressed into base (140) in a conventional manner, securing the wires in place.

Figure 4A:
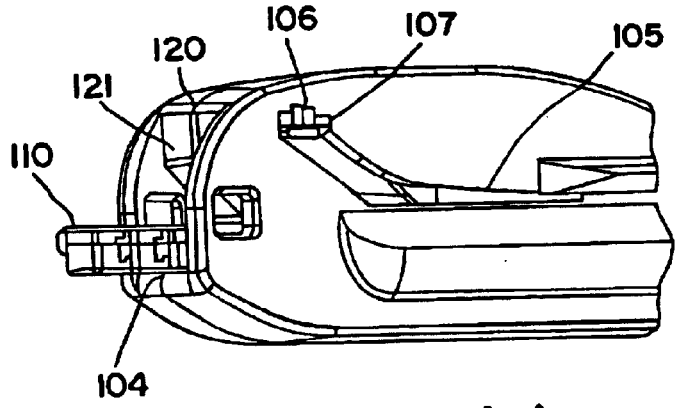
FIGS. 4(*a*)–(*c*) are exploded drawings further illustrating the operation of the preferred embodiment of the invention.
Figure 4B:
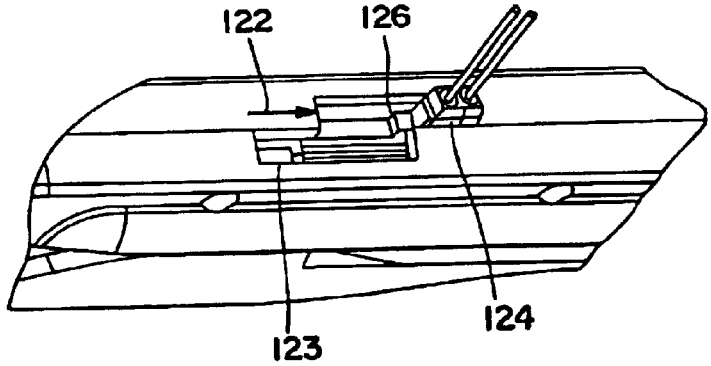
Figure 4C:
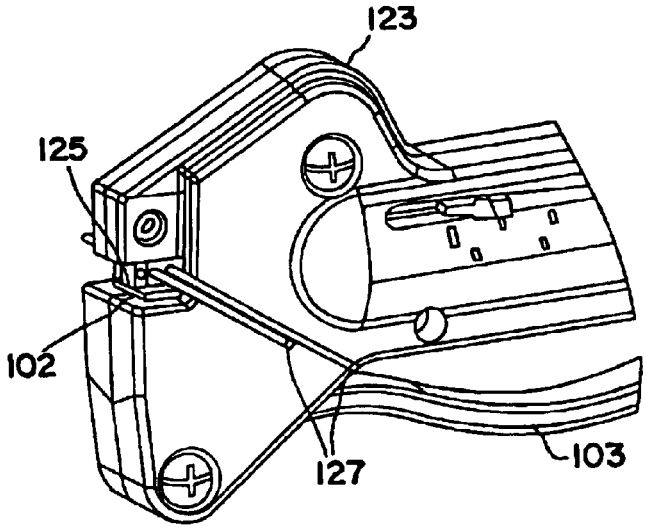

The operation of the preferred embodiment will now be explained in further detail, particularly in connection with FIGS. 4(*a*)–(*c*). To load the terminal connectors into the terminating tool, the user would retract the pusher assembly (106) along pusher track (105), securing it with pusher latch (107). The user would then load terminal connector strip (110) into cavity (120) through open end (104) of terminating tool body (101), as shown in FIG. 4(*a*). Terminating tool preferably includes a keyed track (121) within cavity (120) for orienting and guiding terminal connector strip (110) therethrough.

Before unlatching pusher assembly (106), the user should preferably verify that the connectors of terminal strip (110) are forward of arrow (122) in site window (123), which is preferably integral with gauge slots (124), as shown in FIG. 4(*b*). When the last terminal connector is visible in site window (123), pusher assembly (106) (FIG. 4(*a*)) may be unlatched. This will advance all of the parts forward, and will locate the first connector in terminal connector strip (110) within crimping element (102) (FIG. 1).

As shown in FIG. 4(*c*), the user then inserts wires (127) to be terminated into the connector, closing the handle (103) until the connector cover is forced against the top of connector-housing flange (125) by crimping element (102), terminating the wires within the connector. When handle (103) is released, the terminated connector is ejected from terminating tool (100), and a new connector is forced into position for termination by pusher assembly (106).

The user may next verify that the termination is acceptable by placing the terminating connector in a gauge slot (124), preferably located on the handle side of the terminating tool, as shown in FIG. 4(*b*). The user would determine the largest wire size terminated and select the gauge slot marked with the appropriate AWG (i.e., American Wire Gauge) size. The terminated connector is then preferably inserted into the largest opening for that gauge and slid into the appropriate slot with the end resting on locating shelf (126). If excessive drag is apparent, it will be necessary to close the tool handle tighter in future terminations. Failed connector assemblies may be repaired with a conventional loose piece-terminating tool, as well.

Thus, the terminating tool of the present invention is capable of separating and terminating ultrasonically welded connector strips of various lengths, which provides significant benefits over the systems of the prior art. Moreover, the terminating tool of the present invention allows for control of the terminating connector strip over the majority (e.g., ninety percent) of the pusher assembly track, with a minority (e.g., the last ten percent) of the track accurately locating the connector for termination. This control has a significant advantage in that it allows the ultrasonically welded strip to be manufactured more economically by using a more open assembly process.

For this purpose, support rail (128) (FIG. 2(*b*)) is beneficially provided within the last portion of the track to hold the cover (141) (FIG. 3) of the trailing connector open during termination. As shown in the FIG. 2(*b*), support rail (128) may comprise, for example, a raised guide portion (132) for accurately locating the connector for termination and a ribbed portion (133) for holding the cover open of the terminator connector behind the connector currently being terminated.

By providing a positive latching feature at one end of a pusher assembly track, the preferred embodiments of the present invention have a significant advantage in allowing the pusher assembly to be placed out of the way of the track and restrained when loading the terminal connector strip. Moreover, both the track and the latch position are contained within the profile of the tool, providing a more compact and efficient design.

As shown in FIG. 1, in the preferred embodiment, the outer part of the shell of the tool also preferably has raised feature (130) on both sides along the length of the tool, with a relieved channel (134) therein, allowing the pusher assembly to travel under the operator's hand while maintaining a grip on the tool. Thus terminating tool body (101) is preferably ergonomically designed in this manner, which allows for the terminator connector strip to be easily loaded and fed through to crimping element (102) for termination. Tool body (101) is preferably molded using thermoplastics, but is not limited thereto.

The preferred embodiments of the present invention also preferably have a keyed track, which allows the user to properly orient a connector strip, preventing a connector strip from being loaded incorrectly. In addition, the preferred embodiments also have a site window that allows the operator to verify that the product strip is loaded correctly as well.

Finally, the preferred embodiments of the present invention preferably have the aforementioned gauge (124) molded into the tool itself for a quick verification of a good termination—eliminating the need for a separate gauging tool.

Although this invention has been described with reference to particular embodiments, it will be appreciated that many variations will be resorted to without departing from the spirit and scope of this invention as set forth in the appended claims. For example, the invention may be used with any particular type or gauge of wire, including but not limited to two and three wire telephone cable, computer and power cables, etc.

What is claimed is:

1. A wire terminating system for terminating wires in at least one of a plurality of terminal connectors removably affixed to each other in a terminal connector strip comprising:

a body having a connector positioning cavity therein for receiving said terminal connector strip;

a pushing element within said positioning cavity for advancing said terminal connector strip within said positioning cavity;

a crimping element for receiving at least one of said plurality of terminal connectors from said pushing element; and a support within said positioning cavity for positioning at least one of said plurality of terminal connectors within said crimping element;

a handle moveably attached to said crimping element and said body, wherein said handle and said crimping element are configured to terminate said wires within at least one of said plurality of terminal connectors and to separate said terminal connector from said terminal connector strip; and wherein said tool body further includes one or more gauges for verifying said terminal position.

2. The system of claim 1, wherein said terminal connector comprises a base portion and a cover.

3. The system of claim 1, wherein said terminal connector is a two-wire or three-wire connector.

4. The system of claim 1, wherein said body further comprises a track along which said pushing element travels, said track having a latch positioned to restrain said pushing element to allow said terminal connector strip to be inserted into said connector positioning cavity.

5. The system of claim 1, wherein said tool body further includes a slot window for viewing said terminal connector strip.

6. The system of claim 1, wherein said tool body further includes a guide track within said connector positioning cavity for guiding said terminal connector strip along its length.

7. The system of claim 1, wherein said guide track is keyed for orienting said terminal connector strip.

8. The system of claim 1, wherein said terminal connectors are removably affixed in said terminal connector strip by a means selected from the group consisting of ultrasonic welding and adhesive tape.

9. The system of claim 1, wherein said tool body further comprises a raised feature along its length to allow said pusher assembly to move freely when said tool body is being held.

10. In a wire terminating system having a terminating tool body with a connector positioning cavity therein, a pushing element within said positioning cavity for advancing terminal connectors therein, a crimping element for receiving said terminal connectors from said pushing element, and a handle moveably attached to said crimping element and said body for terminating wires within said terminal connectors, the terminal connector strip comprising a plurality of said terminal connectors removably affixed to each other at a connection point by ultrasonic welding and capable of being separated from said terminal connector strip by said crimping element when said wires are terminated within said terminal connector.

11. The connector strip of claim 10, wherein said terminal connector comprises a base portion and a cover.

12. A wire terminating system for terminating wires in at least one of a plurality of terminal connectors removably affixed to each other in a terminal connector strip comprising:

a body having a connector positioning cavity therein for receiving said terminal connector strip;

a pushing element within said positioning cavity for advancing said terminal connector strip within said positioning cavity;

a crimping element for receiving at least one of said plurality of terminal connectors from said pushing element; and a support within said positioning cavity for positioning at least one of said plurality of terminal connectors within said crimping element;

a handle moveably attached to said crimping element and said body, wherein said handle and said crimping element are configured to terminate said wires within at least one of said plurality of terminal connectors and to separate said terminal connector from said terminal connector strip; and wherein said tool body further includes one or more gauges for verifying said terminal position.

13. A wire terminating system for terminating wires in at least one of a plurality of terminal connectors removably affixed to each other in a terminal connector strip comprising:

a body having a front-end and connector positioning cavity therein for receiving said terminal connector strip in a direction of the front end of the body;

a pushing element within said positioning cavity for advancing said terminal connector strip within said positioning cavity in a direction of the front end of the body;

a crimping element for receiving at least one of said plurality of terminal connectors from said pushing element; and a support within said positioning cavity for positioning at least one of said plurality of terminal connectors within said crimping element;

a handle moveably attached to said crimping element and said body, wherein said handle and said crimping element are configured to terminate said wires within at least one of said plurality of terminal connectors and to separate said terminal connector from said terminal connector strip; and wherein the terminal connector strip comprises a stick substantially elongated and contained within said connector positioning cavity within said body.

14. The system of claim 13, wherein said terminal connector comprises a base portion and a cover.

* * * * *